US006450853B1

(12) United States Patent
Larws

(10) Patent No.: US 6,450,853 B1
(45) Date of Patent: Sep. 17, 2002

(54) BUILDING BLOCK SYSTEM, ESPECIALLY A TOY BUILDING BLOCK SYSTEM

(75) Inventor: Peter Larws, Maienfeld (CH)

(73) Assignee: Palimondial S.A. (LU)

( * ) Notice: Subject to any disclaimer, the term of this patent is extended or adjusted under 35 U.S.C. 154(b) by 0 days.

(21) Appl. No.: 09/763,476

(22) PCT Filed: Aug. 21, 1998

(86) PCT No.: PCT/EP98/05318

§ 371 (c)(1),
(2), (4) Date: Feb. 21, 2001

(87) PCT Pub. No.: WO00/10671

PCT Pub. Date: Mar. 2, 2000

(51) Int. Cl.[7] ..... A63H 33/08
(52) U.S. Cl. ..... 446/93; 446/122; 446/124
(58) Field of Search ..... 446/120, 121, 446/122, 85, 88, 93, 94, 95, 102, 104, 119, 124, 127, 128

(56) References Cited

U.S. PATENT DOCUMENTS 5,267,863 A * 12/1993 Simmons, Jr. ..... 446/127
5,482,491 A * 1/1996 Kichijyo ..... 446/120
5,810,639 A * 9/1998 Liu ..... 446/102
5,853,313 A * 12/1998 Zheng ..... 446/121
5,853,314 A * 12/1998 Bora ..... 446/120

FOREIGN PATENT DOCUMENTS

| | | |
|---|---|---|
| AU | B 12329/76 | 9/1977 |
| DE | 14 78380 | 5/1969 |
| DE | 32145282 | 10/1983 |
| EP | 04 92067 | 7/1992 |
| EP | 0 621 063 | 10/1994 |
| EP | 0751264 | 1/1997 |

* cited by examiner

*Primary Examiner*—Jacob K. Ackun
(74) *Attorney, Agent, or Firm*—R W Becker & Associates; R W Becker

(57) ABSTRACT

A building block system, in particular a toy building block system, comprises a plurality of inter-connectable building blocks (1), whereby each building block (1) comprises an undercut trough-shaped groove (3) on at least one lateral surface (2) into which a connection bar (5) with a cylindrical part (6)is insertable. The building block system is suited for a variety of uses, easy to handle and provides many form-locking connection options of one or several building blocks, including of building blocks of differing geometrical form. According to the invention, the connection bar (5) is also formed with a hammer head-shaped boundary body (7) on at least one end of the cylindrical part (6), which can be inserted into a corresponding recess (11) on the end of the groove (3) in the building block (1) so as to form-lock with the lateral surface (2) of the same, when the connection bar (5) snaps into the groove (3) of the building block (1).

7 Claims, 3 Drawing Sheets

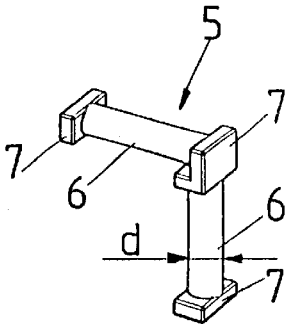
FIG. 5
FIG. 6
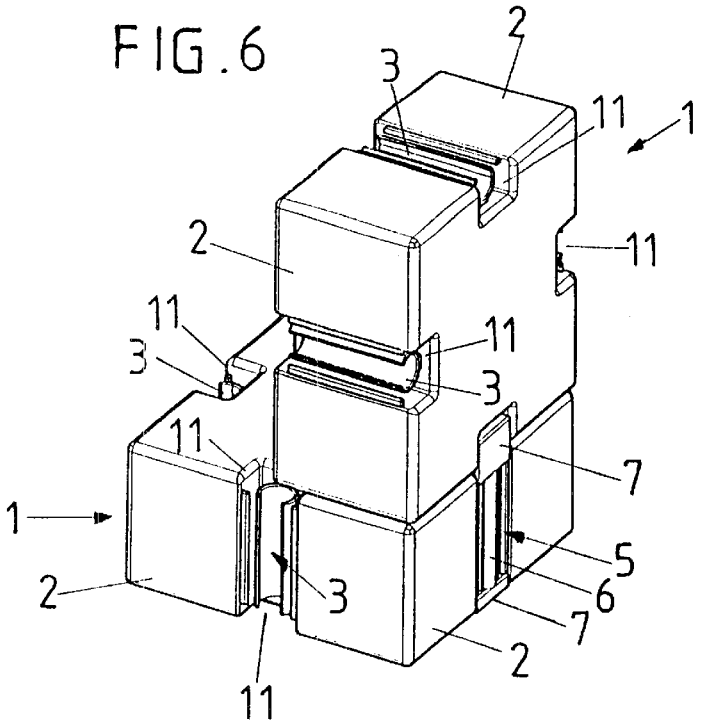
FIG. 8
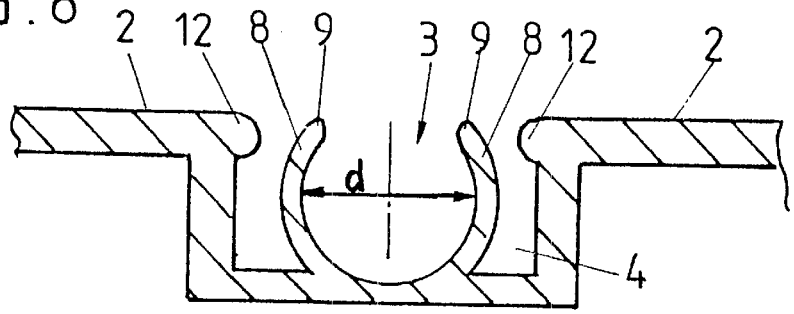
FIG. 9
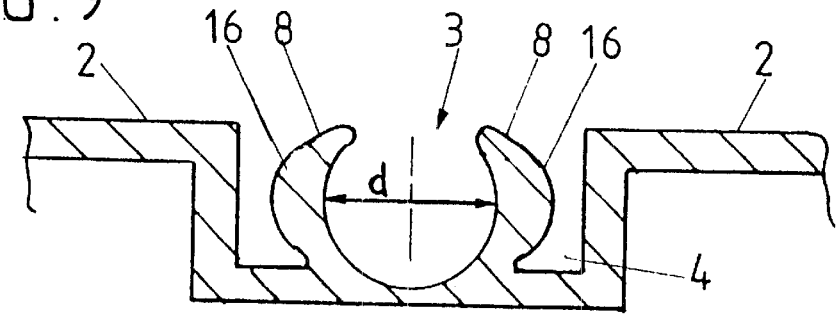

BUILDING BLOCK SYSTEM, ESPECIALLY A TOY BUILDING BLOCK SYSTEM

BACKGROUND OF THE INVENTION

The invention concerns a building block system, in particular a toy building block system, comprising a plurality of inter-connectable building blocks, whereby each building block comprises on at least one lateral surface an undercut trough-shaped groove into which a connection bar with a cylindrical part can inserted.

Building blocks exist for the construction of static objects, whereby these building blocks are merely set on top of or alongside each other without any connection means. The static objects erected with such building blocks lack cohesion, so that they can collapse in the event of vibration.

Building block systems are known in many different embodiments. The building blocks in such building block systems are of differing geometrical forms and are usually connected with each other and assembled into building units by means of tip-stretched coupling members. In addition, toy building blocks are known which are generally combined in large numbers in toy building block systems, or toy building block sets to permit users to combine the toy building blocks into any desired structures and forms. These building blocks are generally made of plastic and often also of metal, wood, stone or the like. In particular if the building blocks are made of plastic they can be assembled into virtually any desired form.

Particularly plastic plug building blocks for playing purposes were until now connected with each other by providing tip-stretched connector elements on the building blocks themselves for plugging and connecting the building blocks to each other. For example, a plug building block is known from the EP-0 492 067 B1 as part of a toy building set in which tip-stretched spring-elastic clamp bars are arranged on the lateral surfaces of the building block. On at least one other lateral surface the building blocks comprise protruding spring plates which can be brought into spring engagement with the clamp bars of another plug building block.

The AU-B 12329/76 discloses a building block system whereby each building block comprises a plurality of protruding nubs on its surface. On its rear, each building block has a plurality of recesses into which the protruding nubs of another building block can be inserted. Many other similar plug building block systems are known.

From the DE-AS-14 78 380 a rectangular toy building block of square diameter is known which comprises one connection groove each on every lateral surface, whereby said groove extends in longitudinal direction and comprises an undercut connecting groove on one end surface and an undercut connecting bar on the other end surface. The undercut grooves are formed as tubular expanding slits into which the connection bar of another building block can be inserted. The connection bar of one building block must thereby be pressed into the connection groove of the other building block with great force because the undercut edges on the connection groove must be slightly widened since the space between the undercut edges of the connection groove is smaller than the width of the connection bar. In particular in plastic building blocks the connection bar or the undercut edges of the connection groove are thereby compressed and deformed. This limits repeated use of the connection elements. If the space between the opposite undercut edges of the connection groove is widened, the connection overall becomes unstable. In addition, the connection bar of one toy building block can be inserted into the undercut groove of another toy building block from the open end of the same. But inserting the connection bar in the groove requires a certain amount of dexterity.

Until now most developments focussed on different forms of building blocks connected by the same tip-stretched coupling members. Depending on the intended use, building blocks of different forms for walls, roofs, vehicles and the like are always connected to each other by the same tip-stretched connection elements to obtain a variety of combination options.

The problem of the present invention is to provide a building block system of the type described above which can be used for a variety of purposes, is easy to handle and permits a multiplicity of form-locking connection options of two or more building blocks, including of building blocks of differing geometrical form.

SUMMARY OF THE INVENTION

According to the invention, this problem is solved in that the connection bar is fitted with a hammer head-shaped boundary body on at least one end of the cylindrical part, whereby said hammer head-shaped body can be inserted into a corresponding recess on the end of the groove in the building block in form-lock with the lateral surface of the same when the connection bar snaps into the groove of the building block. Building blocks of uniform shape, e.g. square blocks, can thereby be connected with each other by separate connection elements of different forms. In addition, building blocks of differing geometrical form, e.g. squares, cubes, semi-cubes, equilateral triangles or cylindrical or wheel-shaped building blocks can be connected with each other. Figures of virtually any desired form, e.g. model vehicles, houses and the like, can thereby be built. The building block system according to the invention is suited preferably for toy building blocks, in particular for children. The building block system can, moreover, be used in furniture construction, fair construction, shop construction and steel construction, and in interior construction as well as for windows, doors, circuit casings etc., without this list being in any sense restrictive. Principally any kind of static object can be built with this building block system. The hammer head-shaped boundary bodies on the ends of the cylindrical part of the connection bar ensure that, during connection of the building blocks by insertion of the connection bar in the building blocks to be connected, a form-locking smooth surface of the connected building blocks is generated, because the hammer head-shaped boundary bodies come into engagement with the corresponding recesses on the ends of the grooves in the building blocks when the connection bar snaps into the grooves of the building blocks, without the hammer head-shaped boundary bodies protruding in any way from the lateral surfaces of the building blocks.

Depending on the intended use of the building block system determined by the static object to be created, the connection bar may comprise at least one cylindrical part or two cylindrical parts arranged in parallel or at least two cylindrical parts arranged at right angles with each other. Building blocks of differing geometrical form can thereby be assembled into different static objects.

According to a preferred embodiment of the invention, the undercut trough-shaped groove consists of two clamp-like grip walls lying opposite each other for receiving the cylindrical part of the connection bar, whereby said grip walls form an essentially tulip shape and are spring-elastic. Tulip shape according to the invention refers to the cross-section of the undercut trough-shaped groove which is substantially circular in form, whereby the two juxtaposed clamp-like grip walls extend beyond the nominal diameter of the circle cross-section and leave an aperture on top. Since the nominal diameter of the trough-shaped groove is therefore not entirely enclosed by the two grip walls, the cross-section presents a tulip-shaped groove. As a result, the grip walls are also spring-elastic. The cylindrical part of the connection bar abuts by its cylinder surface on the elastic contact surfaces of the clamp-like grip walls of the trough-shaped groove when two building blocks are connected to each other. This causes a certain surface pressure between the grip walls of the groove and the connection bar and low wear and tear during connection and disconnection of the building blocks. As a result of the large contact surfaces between the clamp-like grip walls of the trough-shaped groove and the corresponding cylindrical connection bar, sufficient cohesion forces are generated between the connected building blocks despite the low surface compression. A further advantage is that the building block system according to the invention permits easy connection of building blocks in radial direction between the groove and the connection bar. Due to the closed cylindrical form of the connection bars and the lateral surface of the building blocks, the connection is, moreover, very stable.

The undercut trough-shaped groove is advantageously arranged in a channel formed in the lateral surface of the building block, whereby the recesses for receiving the hammer head-shaped boundary bodies which flush-close with the lateral surface of the building block in assembled state of the connection bar are formed on the free ends of the clamp-like grip walls of the groove. The trough-shaped groove defined by the clamp-like grip walls is therefore enclosed in the building block and protected against external damage. In addition, the spring-elastic clamp-like grip walls are permitted to move sufficiently in radial direction in relation to their longitudinal axis during insertion of the cylindrical connection bar. The undercut trough-shaped groove is advantageously formed in one piece with the channel formed in the lateral surface of the building block. This combination of the groove with the channel is particularly easy to realize in the case of plastic profile bars or plastic building blocks due to the good forming properties of plastic.

To prevent violent over-extension or breaking of the clamp-like grip walls of the trough-shaped groove, the channel formed in the lateral surface of the building block is provided with two juxtaposed stops to limit the spring path of the clamp-like grip walls of the groove. This limits the spring action of the grip walls during insertion of the connection bar.

The tulip shape of the undercut trough-shaped groove particularly also derives from the fact that an integrated bar connects the groove to the channel formed in the lateral surface of the building block. This measure provides the trough-shaped groove with a further spring option in the form of the bar.

To increase the stability and clamp effect of the grip walls, the grip walls of the undercut trough-shaped groove are respectively partly thickened.

It is evident that the features described above and to be commented in detail below can be used not only in the combination respectively specified, but also in other combinations or on their own, without going beyond the scope of the present invention.

BRIEF DESCRIPTION OF THE DRAWINGS

The invention shall now be described in more detail by reference to preferred embodiments and to the drawings. The drawings show:

FIG. 5 a plan view of another connection bar for connecting two building blocks;

FIG. 6 a plan view of two connected building blocks according to FIGS. 1 and 5;

FIG. 8 an enlarged cross-section of a partial area of the building block in a second embodiment according to FIG. 2, and FIG. 9 an enlarged cross-section of a partial area of a building block in a third embodiment according to FIG. 2.

DESCRIPTION OF THE PREFERRED EMBODIMENTS

The building block system is described below in particular by reference to block-shaped components which may also be described as semi-cubes.

Figure 1:
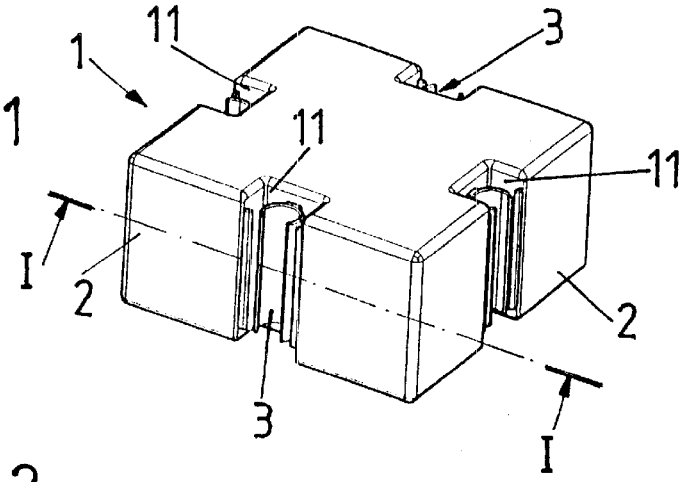
FIG. 1 a plan view of a building block forming part of the building block system according to the invention.
Figure 2:
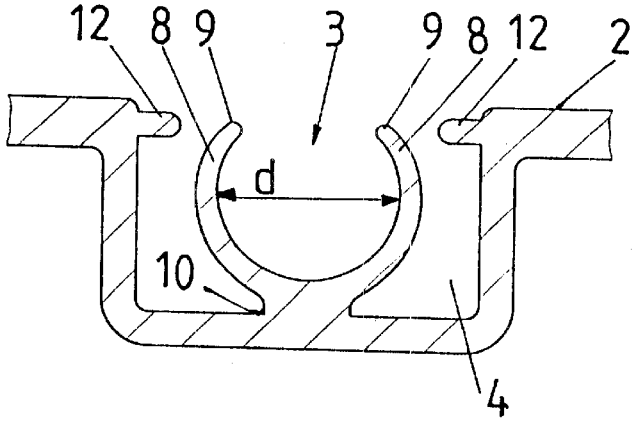
FIG. 2 an enlarged cross-section of a partial area of the building block along the intersection I—I according to FIG. 1 in a first embodiment.

Such a building block 1 is shown in FIG. 1 and in part in FIG. 2. On its narrow lateral surfaces 2 this building block 1 respectively comprises an undercut trough-shaped groove 3 connected in one piece with the channel 4 integrated into the lateral surface 2 and extending in the middle along the narrow surface of the same.

Figure 3:
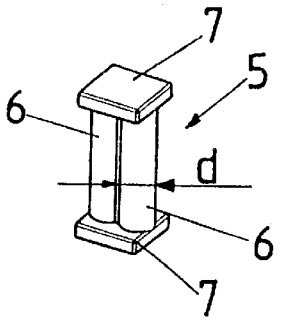
FIG. 3 a plan view of a double cylinder-shaped connection bar for connecting two building blocks.

A connection bar 5 according to FIG. 3 can be inserted in the trough-shaped groove 3 of the building block 1. Said connection bar 5 consists of two cylindrical parts 6 connected with each other in parallel, hence forming a double cylinder diameter, and respectively having a nominal diameter d. On each end of the connection bar 5, a hammer head-shaped boundary body 7 is respectively tip-stretched in single piece on the cylindrical parts 6. The hammer head-shaped boundary bodies 7 are plate-shaped elements preferably of rectangular form extending beyond the cylindrical parts 6 of the connection bar 5.

Figure 4:
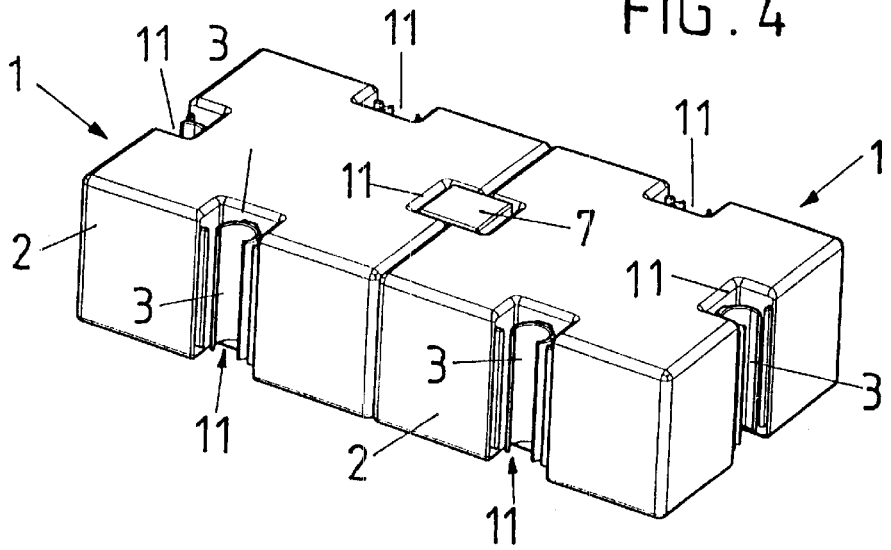
FIG. 4 a plan view of two connected building blocks according to FIGS. 1 and 3.

A particularly advantageous undercut trough-shaped groove 3 is shown in the enlarged partial view of building block 1 in FIG. 2. The trough-shaped groove 3 consists of two spring-elastic tulip-shaped and clamp-like grip walls 8 which largely enclose a nominal diameter d and whose free ends 9 are juxtaposed and form an aperture for receiving a cylindrical or double-cylindrical connection bar 5 according to FIGS. 3 and 5. In their intersection point, the clamp-like grip walls 8 extend into a narrow bar 10, which in turn, is connected in single piece with the channel 4. A recess 11 is respectively formed on the front ends of the trough-shaped groove 3. These recesses 11 come into engagement with the respective corresponding hammer head-shaped boundary bodies 7 of the connection bar 5 when two adjacent building blocks 1 are connected, whereby the hammer head-shaped boundary body 7 flush-closes in form-locking manner with the lateral surface 2 of building block 1 as shown in FIG. 4. Two blocks 12 facing each other are further disposed in channel 4 on juxtaposed walls of the groove 3. Said stop 12 prevent over-stretching or breaking of the clamp-like grip walls 8 during insertion of the connection bar 5. When the grip walls 8 are widened during insertion of the connection bar 5, the outer surfaces of the grip walls 8 abut against the stops 12 if extended that far. The stops 12 may be either rounded or angular or pointed.

FIG. 5 shows another connection bar 5 substantially consisting of two cylindrical parts 6, each with a nominal diameter d, which are connected to each other at right angles. The free ends of the cylindrical parts 6 respectively comprise a hammer head-shaped boundary body 7 which respectively engages with a corresponding recess 12 of the lateral surface 2 of a building block 1. A further hammer head-shaped boundary body 7 is formed in the intersection point of the two cylindrical parts 6. Building blocks 1 of like or different form can be connected by means of this connection bar 5 at right angles, as shown in FIG. 6.

Figure 7:
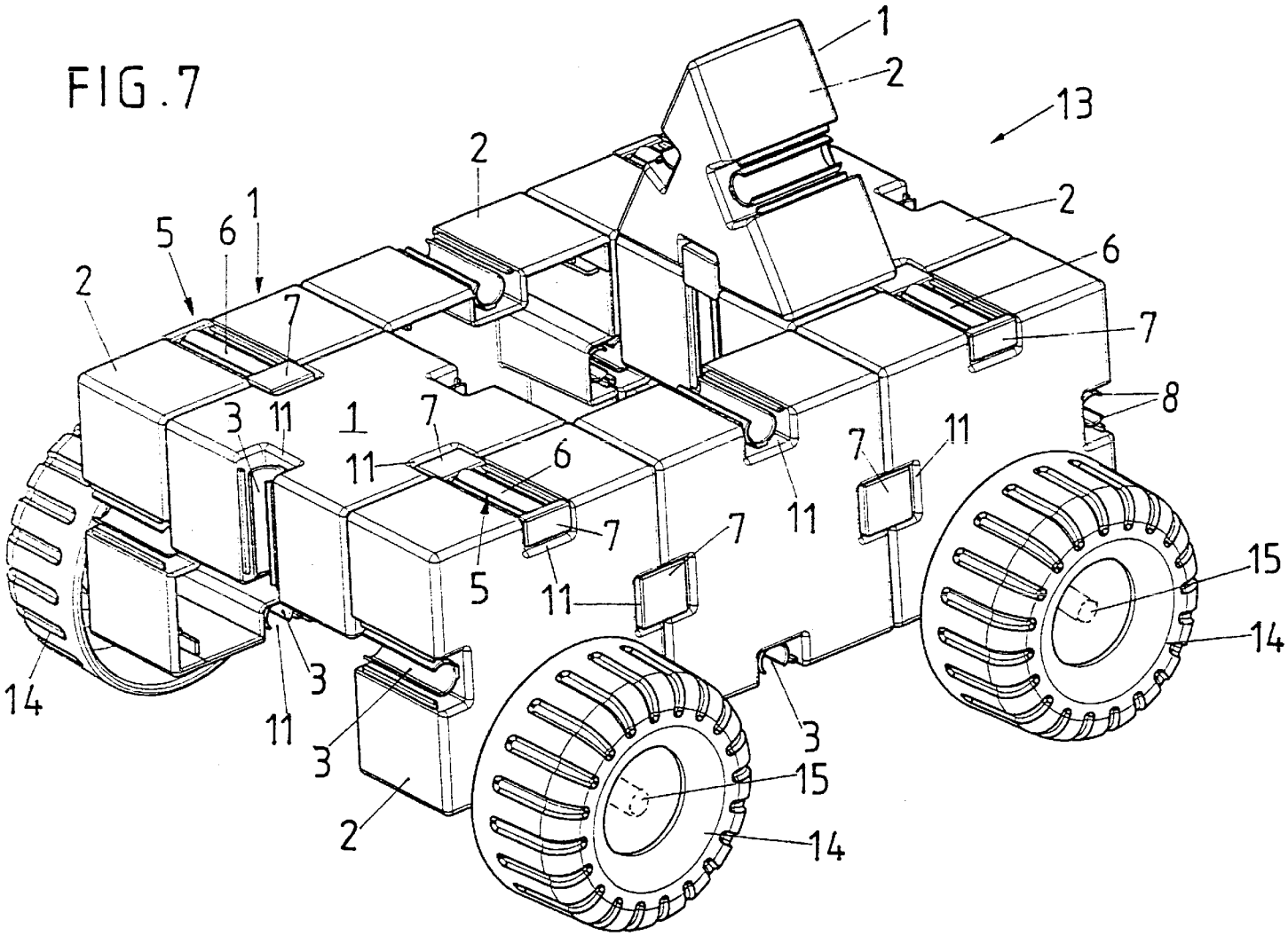
FIG. 7 a plan view of a model vehicle made of a multiplicity of building blocks connected to each other.

The combination of the building blocks 1 with the above-described connection bars 5 permits connecting and assembling a multiplicity of building blocks 1 of like or different geometrical form into any desired static objects. As an example, FIG. 7 shows a model toy vehicle 13 with four wheels 14. The wheels 14 are connected to the associated building block 1 by means of simple plug axes 15, whereby the respective plug axes 15 are plugged into the grip walls 8 of the grooves 3 of the building block 1. On a plurality of building blocks 1 a triangular building block 1 is also connected to one of the block-shaped building blocks 1 by a connection bar 5 shown in FIG. 5.

Another embodiment of the undercut trough-shaped groove 3 in the channel 4 of the building block 1 is shown in FIG. 8. Here the clamp-like grip walls 8 directly extend to form the channel 4 without a bar being interposed.

According to a further embodiment of the undercut trough-shaped groove 3 of the building block 1 according to FIG. 9, the clamp-like grip walls 8 respectively comprise a bulge 16 to prevent break-off of the clamp-like grip walls 8 during insertion of a connection bar 5. Stops to limit the spring path of the grip walls 8 may be dispensed with in this embodiment.

REFERENCE NUMERALS

1 building block
2 lateral surface
3 undercut trough-shaped groove
4 channel
5 double-cylinder connection bar
6 cylindrical part
7 hammer head-shaped boundary body
8 clamp-like grip wall
9 free end
10 bar
11 recess
12 stop
13 toy vehicle
14 wheel
15 plug axis
16 bulge

What is claimed is:

1. A building block system comprising:

a plurality of interconnected building blocks, each of which is provided on at least one lateral surface thereof with an undercut groove, which has a recess at at least one end thereof; and respective connection bars having two cylindrical parts for engaging said groove, wherein said cylindrical parts are provided at at least one end with a hammer head shaped boundary body that, when said cylindrical parts of a connection bar engage said groove, is insertable into said recess of said groove so as to be form-locking with a lateral surface of said groove, and wherein said cylindrical parts are disposed parallel along side one another.

2. A building block system according to claim 1, wherein said groove comprises two oppositely disposed, clamp-like grip walls for receiving said cylindrical parts of said connection bar, and wherein said grip walls are substantially tulip shaped and are spring elastic.

3. A building block system according to claim 2, wherein said lateral surface for said groove has a channel in which said grip walls are disposed, and wherein said recesses of said grooves are provided at ends of said grip walls for receiving said hammer head shaped boundary bodies, which in an assembled state when a cylindrical part of a connection bar engages a groove, are flush with an associated lateral surface of a building block.

4. A building block system according to claim 3, wherein oppositely disposed walls of said channel of said lateral surface are each provided with a stop for limiting a spring path of said clamp-like grip walls of said groove.

5. A building block system according to claim 3, wherein said grip walls of said groove are connected to a base of said channel of said lateral surface by means of an integral bar.

6. A building block system according to claim 2, wherein said grip walls of said groove are each thickened, at least in part.

7. A building block system comprising:

a plurality of interconnected building blocks, each of which is provided on at least one lateral surface thereof with an undercut groove, which has a recess at at least one end thereof; and respective connection bars having at least two cylindrical parts for engaging said groove, wherein said at least two cylindrical parts are disposed at right angles to one another, wherein said at least two cylindrical parts are provided at at least one end with a hammer head shaped boundary body that, when said at least two cylindrical parts of a connection bar engage said groove, is insertable into said recess of said groove so as to be form-locking with a lateral surface of said groove.

* * * * *